3/13/84 OR 4,437,099

United States Patent [19]

Kandler

[11] 4,437,099

[45] Mar. 13, 1984

[54] POLARIZATION CONVERTER FOR ELECTROMAGNETIC WAVES

[75] Inventor: Erich Kandler, Munich, Fed. Rep. of Germany

[73] Assignee: Siemens Aktiengesellschaft, Berlin & Munich, Fed. Rep. of Germany

[21] Appl. No.: 246,122

[22] Filed: Mar. 20, 1981

[30] Foreign Application Priority Data

Jun. 24, 1980 [DE] Fed. Rep. of Germany ..... 3023561

[51] Int. Cl.[3] ..... H01Q 15/24

[52] U.S. Cl. ..... 343/756; 343/872

[58] Field of Search ..... 343/756, 879, 909

[56] References Cited

U.S. PATENT DOCUMENTS

| | | | |
|---|---|---|---|
| 2,607,009 | 8/1952 | Affel | 343/756 |
| 2,934,762 | 4/1960 | Smedes | 343/756 |
| 2,970,312 | 1/1961 | Smith | 343/756 |
| 3,309,705 | 3/1967 | Blank et al. | 343/756 |
| 3,656,166 | 4/1972 | Klopach et al. | 343/756 |
| 3,754,271 | 8/1973 | Epis . | |
| 4,001,836 | 1/1977 | Archer et al. | 343/756 |
| 4,189,731 | 2/1980 | Rope et al. | 343/756 |

*Primary Examiner*—Eli Lieberman

*Attorney, Agent, or Firm*—Hill, Van Santen, Steadman & Simpson

[57] ABSTRACT

The invention relates to apparatus for converting electromagnetic waves with a particular polarization into waves having circular polarization wherein a single or multi-layer conductor grid structure is placed in front of the radiation aperture. If it is necessary due to spatial requirements of the radome, the circular polarization grid may be non-planar and according to the invention the geometric development of the grid structure can be determined by projecting a desired grid structure disposed in the radiation aperture plane upon a non-planar such as a cone-shaped surface. The manufacture of the grid structure can be accomplished by first forming the grid structure on a surface such as plastic with conducting strips or members formed thereon and so arranged such that when the plastic sheet is formed into a cone by removing a pie-shaped segment the desired non-planar pattern results.

10 Claims, 11 Drawing Figures

POLARIZATION CONVERTER FOR ELECTROMAGNETIC WAVES

BACKGROUND OF THE INVENTION

1. Field of the Invention

This invention relates in general to means for converting electromagnetic waves having a given polarization into those having circular polarization by using a single or multi-layer conductor grid structure placed in front of the radiation aperture of an antenna.

2. Description of the Prior Art

Radar apparatus often is constructed with its tracking antenna adapted for linear polarization because with linear polarization under normal conditions the greatest range can be achieved. However, with a linearly polarized antenna, it is not possible to distinguish rain cloud echo signals which have a particular spectral distribution that is similar to actual moving target echo signals from real actual moving target echo signals. When using circular polarization on the other hand, rain cloud echo signals are strongly attenuated and distinguishing between actual moving targets and rain clouds can be easily accomplished. Therefore, in many instances the linear polarization of an antenna is converted into circular polarization for example by means of a polarization grid placed in front of the radiation aperture which are polarization grid is customarily integrated in the radome structure. Such known circularization grids are described for example in U.S. Pat. No. 3,754,271 and such grid is planar in shape.

A planar circular polarized grid of this type, however, frequently cannot be installed in existing radome in front of a radiation aperture because the available space does not allow such installation.

SUMMARY OF THE INVENTION

It is an object of the present invention therefore to provide for the construction of a circular polarization grid and wherein the conductor grid structure is arranged on a non-planar surface and wherein the geometric progression of the grid structure on the non-planar surface is determined by the projection of a desired grid structure arranged in the aperture plane so as to produce a circular polarized grid on the non-planar surface.

The basic concept of the invention is in transferring the conductor structures employed in the case of planar circular polarization grids over non-planar particularly curved surfaces.

Due to the economy of manufacture metal structures comprising patterns etched on surfaces are most commonly utilized rather than grate-shaped laminated grids. Thus, it is expedient to select as the curved surface to be used a cone-shaped envelope surface which can be formed by forming a flat disc and removing a pie-shaped segment upon which the metal polarizing patterns are formed and subsequently the flat disc-shaped member can be formed into a cone by joining the edges where the pie-shaped member was removed. In the case of cone envelope shaped circular polarization grids according to the invention, during manufacture it is a problem to project the planar pattern in the cone area onto the cone envelope surface. Since the conductor layers cannot be readily manufactured in conical shape according to the invention, the cone-shaped surface is developed into the planar form and then the conical form is then produced. The same manufacturing principles apply to other non-planar surfaces on which the circular polarization grids to be prepared are formed.

For the frequency band width customary particularly in the case of tracking radar installations, various conductor patterns for circular polarization grids can be considered. The grid structure can, for example, consist of continuous parallel lines, meandering lines, lined up rectangles formed in lines or other similar structures.

If due to the varying cross-coupling in the case of the cone envelope shape or other non-planar circular polarization grids, intervals and spacings between the continuous lines, meander lines, rectangle lines and the like are necessary for an optimum circular polarization with the intervals being different than those from a planar grid and a corresponding correction can be made during the manufacture of the grid for example, when the metal is etched on the cone envelope surface.

Other objects, features and advantages of the invention will be readily apparent from the following description and claims when read in view of the drawings in which:

DESCRIPTION OF THE PREFERRED EMBODIMENTS

Figure 1A:
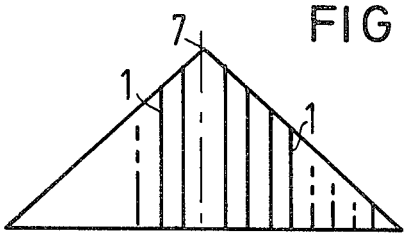
FIG. 1A illustrates the cone-shaped grid according to the invention from the side view.
Figure 1B:
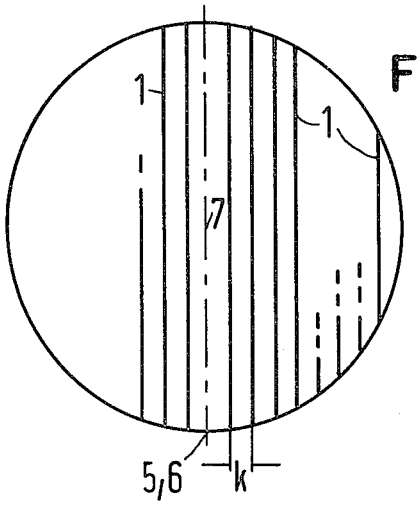
FIG. 1B illustrates the cone-shaped grid in the top plan view.

FIG. 1A is a side plan view of a conical-shaped circular polarization grid according to the invention and FIG. 1B is a top plan view of the conical shaped polarization grid of the invention. The conical-shape polarization grid can be integrated with the radome of a reflector mirror of a tracking radar antenna and consists of a plurality of metallic conductors 1 which run parallel to each other as illustrated in FIGS. 1A and 1B and which are equally spaced relative to each other as, for example, with the spacing k and are symmetrical about the apex 7. It is to be realized that the conductive lines 1 are formed on a suitable plastic film or other surface which is capable of holding the conical shape.

Figure 2A:
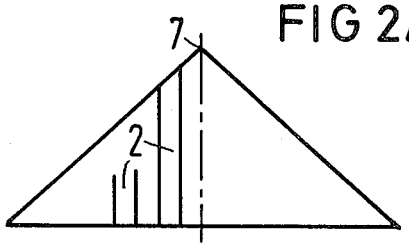
FIG. 2A is a side plan view of a modification of the conical-shaped grid of the invention.
Figure 2B:
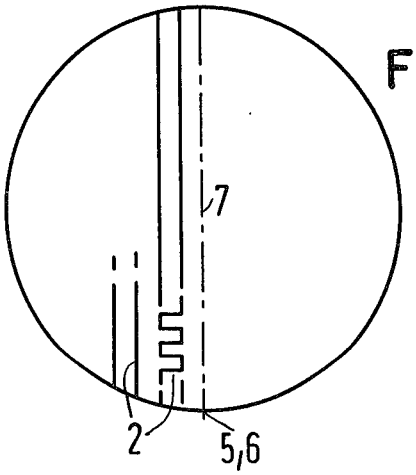
FIG. 2B is a top plan view of the modified form of the invention.

FIG. 2 illustrates in FIG. 2A a side plan view of a conical shaped circular polarization grid and FIG. 2B a top plan view of a circular polarization grid which is modified from that shown in FIGS. 1A and 1B in that in FIG. 2A and FIG. 2B rather than having a plurality of parallel conductive lines as in FIGS. 1A and 1B a plurality of meandering lines 2 extend across the conical shape grid. It is to be realized that in FIGS. 2A and 2B only a portion of the meandering conductors are illustrated but it is to be realized that the meandering conductors extend parallel to each other as shown within the areas designated by numerals 2 in the Figures. The meandering conductors 2 run in plan and lateral view parallel to each other in the direction of the main extension and have mutual equal intervals.

Figure 3A:
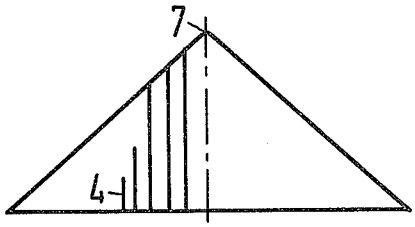
FIG. 3A is a side plan view with further modification of the invention.
Figure 3B:
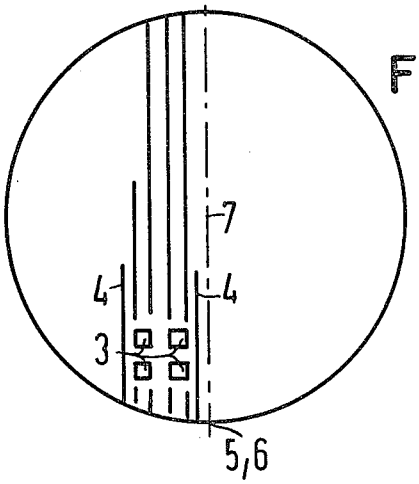
FIG. 3B is a top plan view of the conical-shaped modification of the invention.

A third embodiment of a conical shape circularization polarization grid is illustrated in FIGS. 3A and 3B wherein the conductive grid structure comprises a plurality of parallel conductive lines 4 between which are spaced rows of rectangular or square conductive areas 3 which are ranged in two parallel rows as are indicated in the top plan view of FIG. 3B. It is to be realized that only a few of the rectangles are shown in FIG. 3B.

In developing the described conical circular polarization grids, there is a problem of projecting the planar pattern such that it has the shape illustrated in FIGS. 1, 2 and 3A and B because the cone shape is not printed or applied with the conductors on the conical envelope shape but rather when the material is flat.

Figure 4:
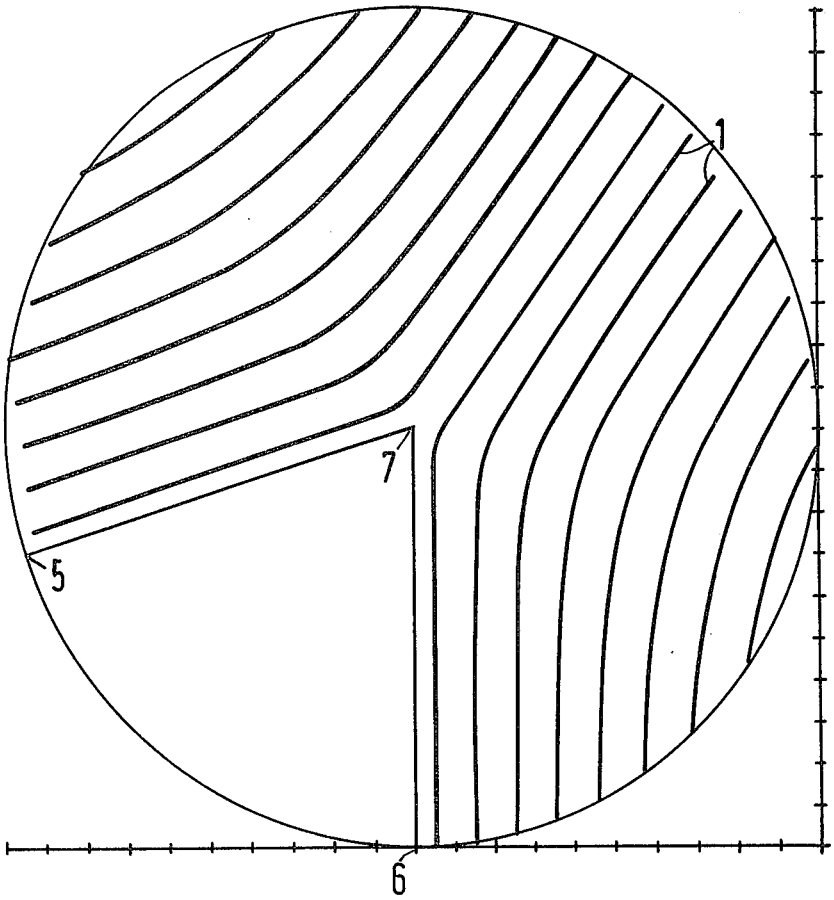
FIG. 4 comprises a planar layout for the cone envelope surface of the grid according to FIGS. 1A and 1B.

For this purpose, FIG. 4 illustrates how the cone-shaped grid illustrated in FIGS. 3A and 3B can be manufactured. As shown in FIG. 4, a flat disc-shaped form of backing material such as plastic is cut and then a pie-shape segment defined by points 5, 7 and 6 is removed from the disc-shaped material. Then the conductive lines 1 are printed or applied to the plastic layer in the shape illustrated in FIG. 1. It is to be noted that the lines generally run parallel to each other toward the upper right of the Figure and that the lines run parallel respectively to the segments 5, 7 and 6 as illustrated. The cone envelope is then formed by joining segment 5, 7 with segment 6, 7 to form a cone with point 7 being the apex of the cone. FIG. 1B illustrates the line segments 5, 7 and 6, 7 which have been joined.

Figure 5:
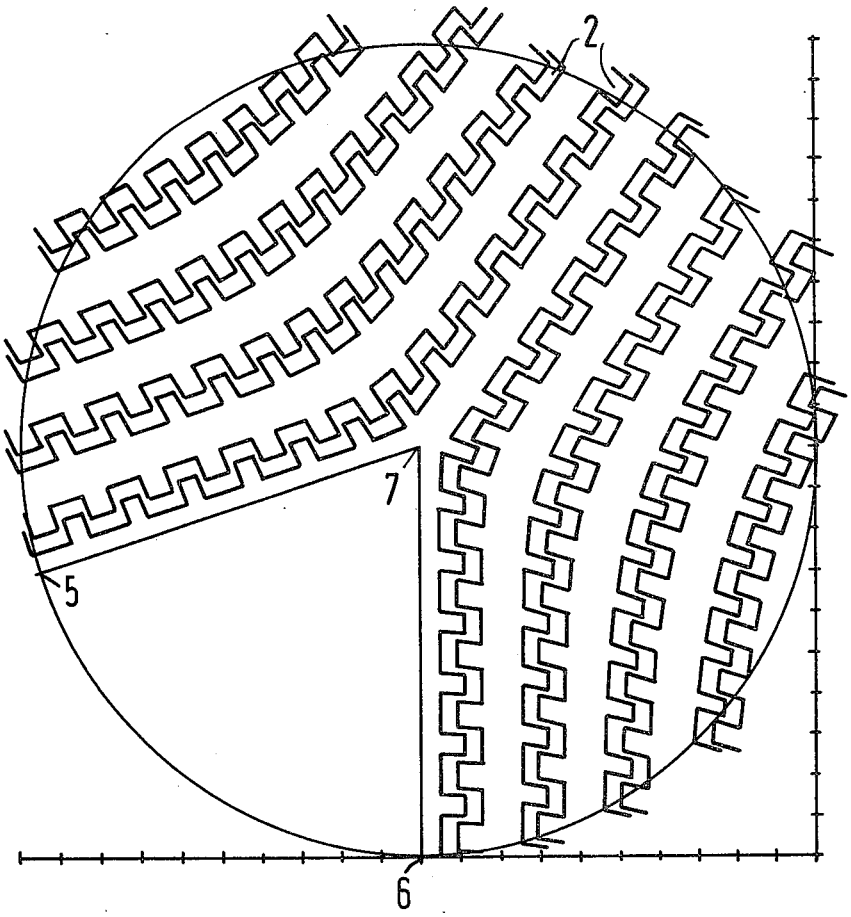
FIG. 5 is a planar layout of the modified form of the cone envelope surface illustrated in FIGS. 2A and 2B.

FIG. 5 illustrates in plan view the plastic backing material with the conductors 2 printed thereon and it is developed similar to the structure illustrated in FIG. 4. It is to be noted that the meandering conductor lines 2 extend in the same general directions as the lines 1 in FIG. 4 such that when the lines 5, 7 and 6, 7 are joined to form the conical section, the resulting side and top plan views will be as illustrated in FIGS. 2A and 2B respectively.

Figure 6:
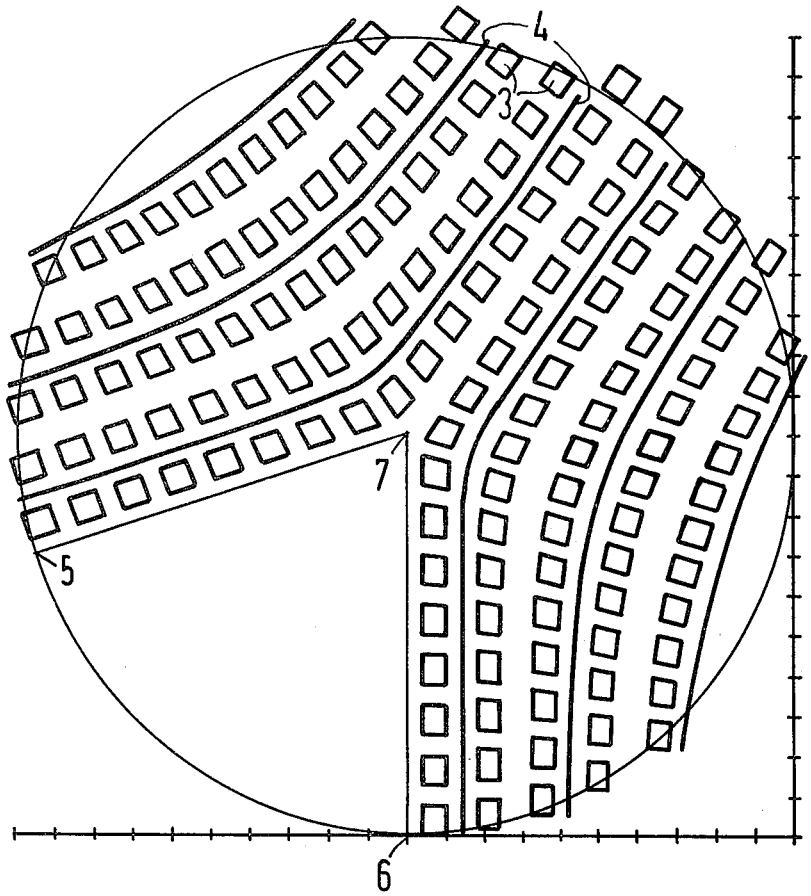
FIG. 6 is a plan layout of the cone envelope surface of the conical grid illustrated in FIGS. 3A and 3B.

FIG. 6 illustrates the plan development of the cone-shaped surface of FIGS. 3A and 3B wherein the lines 4 separate pairs of rows of metallized squares or rectangles 3 as illustrated. It is to be noted that a longitudinal direction of the arrangement of these conductors is analogous to that of the lines 1 illustrated in FIG. 4.

Figure 7:
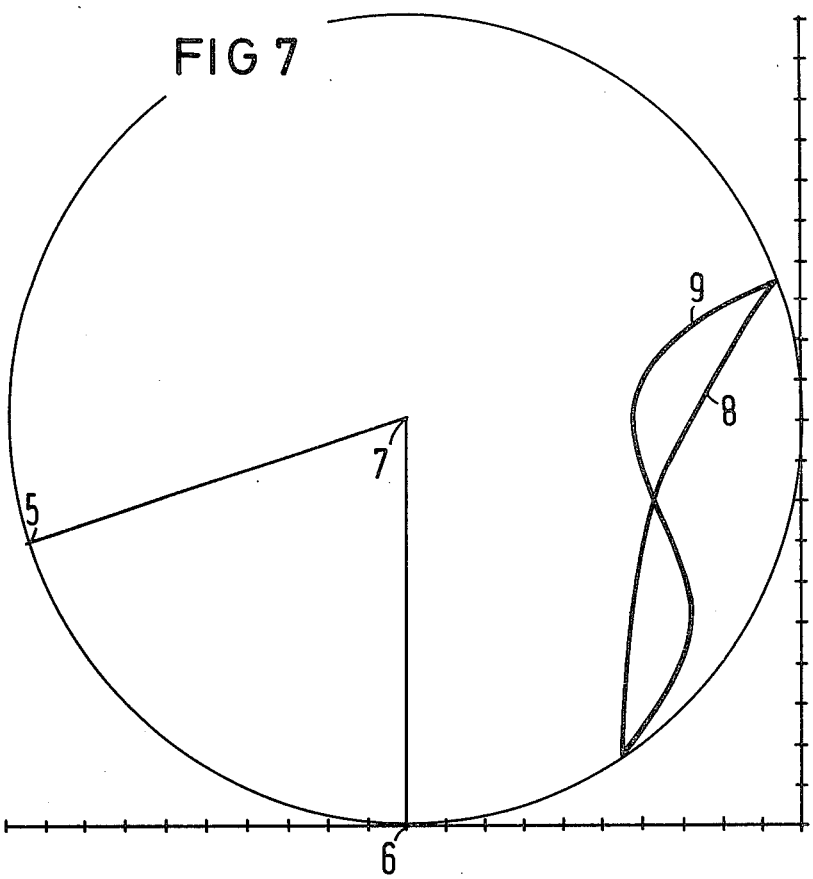
FIG. 7 is a plan layout for a conical envelope surface for an example of a sine line with its base line projected; and, FIG. 8 illustrates a tracking radar antenna with a cover according to the invention mounted thereon.

FIG. 7 illustrates a planar layout of a cone envelope surface upon which a sine line 9 and its base line 8 are developed such that when the cone is formed by joining the line segments 5, 7 and 6, 7 the base line 8 will appear as a straight line in the top planar view of the cone and the sine wave line 9 will appear as a true sine wave line. It is to be noted that the sine wave in the planar view of FIG. 7 is distorted and that the line 8 is not straight in actual development on the planar surface.

The conical grids formed according to the invention can be mounted without difficulty in already existing radomes for example of tracking radar antenna wherein due to the available dimensions a planar circular polarization grid cannot be utilized. Electrical loss will not result due to the design of the grid according to the invention.

Figure 8:
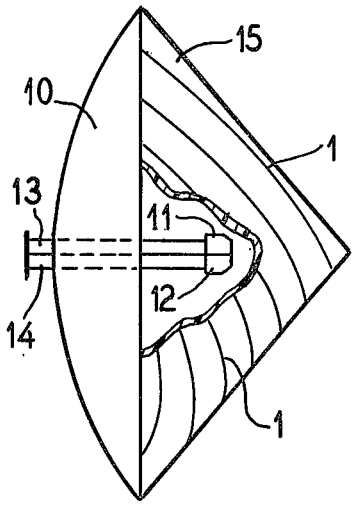

FIG. 8 illustrates a tracking radar antenna comprising a reflector mirror 10 which has feed means 11 and 12 mounted at its focal point and feed lines 13 and 14 connected to the feed point means. A cover 15 of conical-shape is attached to cover the reflective mirror 10 and it has a grid structure 1 formed on the surface so as to produce circular polarized energy from the antenna 10.

Although the invention has been described with respect to preferred embodiments, it is not to be so limited as changes and modifications can be made which are within the full intended scope of the invention as defined by the appended claims.

I claim as my invention:

1. The method of forming a non-planar polarization grid structure comprising, forming conductive lines on a disc of planar insulation material, removing a pie-shaped portion of said disc, and joining the edges of said disc where the pie-shaped portion was removed to form a cone and the pattern of said conductive lines as viewed from the apex of the cone having the desired shape to obtain circular polarization.

2. A grid structure for converting electromagnetic waves having a given polarization to a circular polarization comprising, a conical-shaped surface of insulation material with conductive lines formed thereon with the conductive lines when projected on a plane normal to the conical-shaped surface being parallel to each other.

3. A single- or multiple-layer conductor grid line structure placed in front of a radiation aperture for converting electromagnetic waves having a given polarization to circular polarization, characterized in that the conductor grid line structure (1) for converting electromagnetic waves having a given polarization to circular polarization is arranged to form a non-planar surface, and the geometric progression of the grid line structure (1) on the non-planar surface corresponds to the top plan view of an imaginary circular polarization producing grid line structure placed in the plane of said radiation aperture.

4. A structure according to claim 3, characterized in that said aperture comprises a tracking radar antenna with a cover and reflector mirror, and said grid structure is integrated with the reflector aperture radome cover.

5. A single- or multiple-layer conductor grid structure placed in front of a radiation aperture for converting electromagnetic waves having a given polarization to circular polarization, characterized in that the conductor grid structure (1) for converting electromagnetic waves having a given polarization to circular polarization is arranged to form a non-planar surface, and the geometric progression of the grid structure (1) on the non-planar surface is determined by the projection of an imaginary circular polarization producing plane grid structure on said non-planar surface, and characterized in that the non-planar surface is a cone envelope surface with the apex projecting toward the exterior in front of a circularly designed radiation aperture with the symmetry axis of said cone envelope surface coinciding with the mean perpendicular to the radiation aperture.

6. A structure according to claim 5 comprising etched metal strips on a plastic sheet.

7. A structure according to claim 5 comprising etched metal strips on a plastic sheet consisting of continuous lines (1).

8. A structure according to claim 5 comprising etched metal strips on a plastic sheet consisting of meander lines (2).

9. A structure according to claim 5 comprising etched metal strips on a plastic sheet of lines and adjacent rectangles (3).

10. A structure according to claim 5 used as an aperture cover for an antenna.

* * * * *